US006149202A

United States Patent [19]

Anzai

[11] Patent Number: 6,149,202

[45] Date of Patent: Nov. 21, 2000

[54] PAGE MARKER CARRIER ASSEMBLY AND PRODUCTION THEREOF

[75] Inventor: Shuji Anzai, S. Burlington, Vt.

[73] Assignee: Bertek Systcms, Inc., Cincinnati, Ohio

[21] Appl. No.: 09/289,873

[22] Filed: Apr. 12, 1999

[51] Int. Cl.[7] ..... B42D 15/00

[52] U.S. Cl. ..... 283/36; 283/41; 283/42

[58] Field of Search ..... 283/36, 37, 38, 283/39, 40, 41, 42; 40/359, 360; 206/214, 232

[56] References Cited

U.S. PATENT DOCUMENTS

| | | | |
|---|---|---|---|
| 5,046,609 | 9/1991 | Mangini et al. | 206/232 |
| 5,072,831 | 12/1991 | Parrotta et al. | 206/232 |
| 5,249,827 | 10/1993 | Olso | 283/42 |
| 5,462,783 | 10/1995 | Esselmann | 283/36 |
| 5,901,842 | 5/1999 | Berger | 206/232 |
| 5,906,397 | 5/1999 | MacWilliams et al. | 40/359 |

*Primary Examiner*—David T. Fidei
*Attorney, Agent, or Firm*—Thomas N. Nciman

[57] ABSTRACT

The present invention is directed to a page marker carrier assembly which is a unit for transporting a page marker which allows a consumer to open the assembly and remove the page marker and position the marker onto a page of a catalogue. The page marker carrier assembly is comprised of a combination of units that include a primary unit that consists of a layer of face stock having an adhesive layer which attaches to a liner material and is coated with adhesive on its top surface to affix the secondary unit, composed of a folded sheet of material that is coated on either side with a release coating. A tertiary unit is composed of a material, paper or plastic or synthetic that is coated on the side facing the release coating on the secondary unit with a pattern or strip of adhesive, either permanent, removable or repositional. A layer of adhesive is positioned between the primary and secondary units. The construction is designed to provide a carrying unit for the page markers. A method of producing the page marker carrier assembly is also disclosed.

21 Claims, 4 Drawing Sheets

PAGE MARKER CARRIER ASSEMBLY AND PRODUCTION THEREOF

BACKGROUND OF THE INVENTION

This invention pertains to transportation devices for carrying a page marker product, and in particular, to a page marker carrier assembly that is designed to allow the consumer to remove and reposition a page marker tab from the page marker carrier assembly quickly and easily. A method of producing the page marker carrier assembly is also disclosed.

Currently, there are devices designed to carry and allow the user to dispense tab like page markers. These are currently available in a single sheet carrier and in compact dispenser units. The sheeted product can provide for the dispensing of multiple page marker tabs. The number of which are limited by the overall size of the single piece, flat carrier. As the number of page markers increase, so does the size of the carrier needed. Thus limiting the size of the catalogue or printed manual in which it is inserted, bound and affixed. Additionally, there exists compact dispensers that allow multiple tabs to be used, however, at substantial cost. Catalogue users want to have a greater number of tabs available for use at a reasonable cost. What is needed is a cost effective compact carrier that provides multiple tabs carried on a folded carrier that can be unfolded to a greater size.

Clearly, it is desirable for an item of this type to be very adaptable. At the same time, the item should be easy to manufacture and be produced of cost effective material. It is the object of this invention to set forth a removable note product carrier assembly which avoid the disadvantages, previously mentioned limitations of other assemblies.

SUMMARY OF THE INVENTION

Particularly, it is the object of this invention to teach a page marker carrier assembly, for use in providing page marker tabs which can be used by a consumer by opening the page marker carrier assembly, unfolding the page marker carrier sheet, and removing the page marker tabs from the assembly and positioning it on another location such as a page of a catalogue, said structure comprising a page marker carrier assembly comprising a plurality of units; a primary unit comprising a pressure sensitive material, said material having a facestock ply, said facestock ply having a front side and a rear side; said primary unit further comprising a liner ply, said liner ply having a front side and a back side; said back side of said facestock ply having a coating of pressure sensitive adhesive; said front side of said liner material having a layer of release coating thereon; said primary unit having a coating of adhesive on said front side of said facestock ply for facilitating lamination with said secondary unit; said secondary unit comprising a sheet of material, said sheet of material having a front side and a back side, a portion of said back side of said sheet of material being laminated to said primary unit; said sheet of material of said secondary unit comprising a folded unit; said front side of said secondary unit having a layer of release coating positioned thereon; selected areas of said layer of release coating on said front side of said secondary unit having adhesive positioned thereon; a tertiary unit comprising at least one page marker tab, said page marker tab having a front side and a back side; said back side of said page marker tab having a layer of adhesive positioned thereon from said secondary unit during the lamination process; and said secondary and said tertiary unit comprising a folded unit such as to confine said page marker tabs to the interior of said folded unit.

Also, it is the object of this invention to teach a page marker carrier assembly, for use in providing page marker tabs which can be used by a consumer by opening the page marker carrier assembly, unfolding the page marker carrier sheet, and removing the page marker tabs from the assembly and positioning it on another location, such as a page of a catalogue, comprising in combination a page marker carrier assembly comprising a base unit and a carrier unit adjacent to each other and a page marker tab unit, said base unit and said carrier unit having a front side and a rear side; said base unit comprising in combination a sheet of material, said sheet of material having a layer of adhesive on said front side and a liner attached to said front side thereof, and said liner having a layer of adhesive positioned on the side away from said sheet of material; said carrier unit comprising in combination a sheet of material, said sheet of material having a layer of release coating positioned on said front side thereon and a pattern of adhesive positioned over said release coating, and at least one page marker tab unit positioned on said adhesive over said release coating; and said sheet of said carrier unit comprising a unit to be folded into position over said first unit and enclosing said page marker tab unit therein.

It is also the object of this invention to teach a method of producing a page marker carrier assembly, for use in providing page marker tabs which can be used by a consumer by opening the page marker carrier assembly, unfolding the page marker carrier sheet, and removing the page marker tabs from the assembly and positioning it on another location, such as a page of a catalogue, said method comprising the steps of providing a plurality of sheets of material, each of said sheets having a front side and a rear side forming a primary and secondary unit; printing the sheets of material; applying a coating of release agent in predetermined areas of the secondary sheet of material; applying at least one adhesive layer as desired over the coating of release agent; providing said sheet of material comprising page marker tabs over the adhesive layer on said secondary sheet of material; die cutting the page marker tab into page marker tabs; stripping away waste matrix material; and folding said secondary sheet of material as necessary to form the carrier for said page marker tabs, and for positioning the folded carrier over one of the coated areas of adhesive for sealing the unit and for providing opening and closing of the folded carrier; applying said folded carrier sheet of material onto a pressure sensitive base; die cutting the combined unit as necessary; stripping away the waste matrix material in order to provide a finished page marker carrier assembly.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 1:
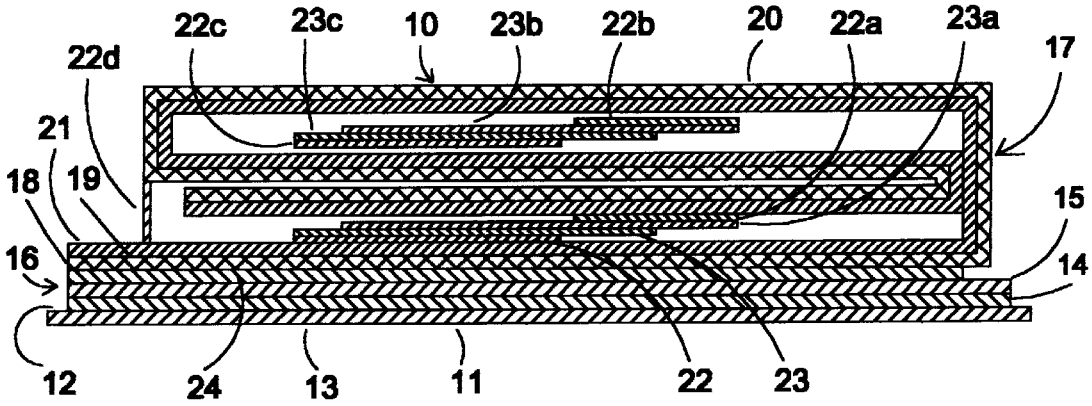
FIG. 1 is an exploded cross sectional view of the novel page marker carrier assembly.
Figure 2:
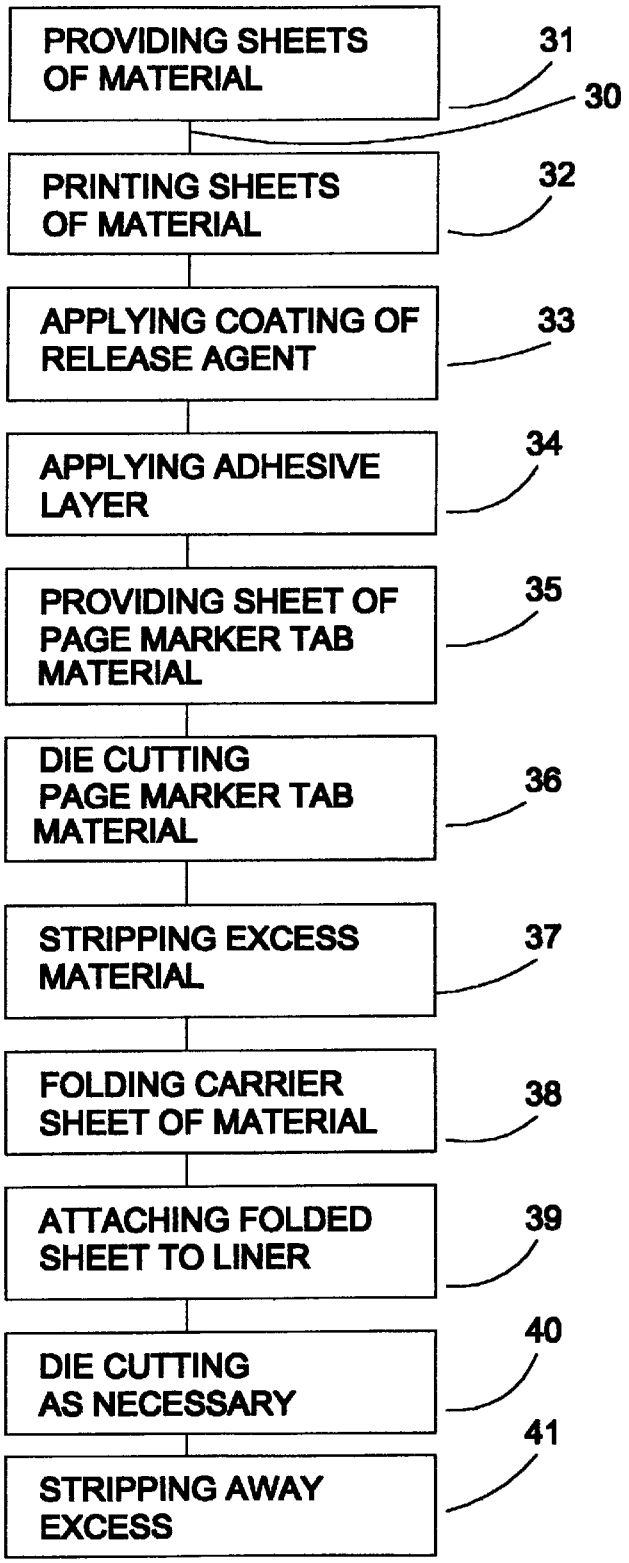
FIG. 2 is a block diagram showing the novel method of producing the page marker carrier assembly.
Figure 4:
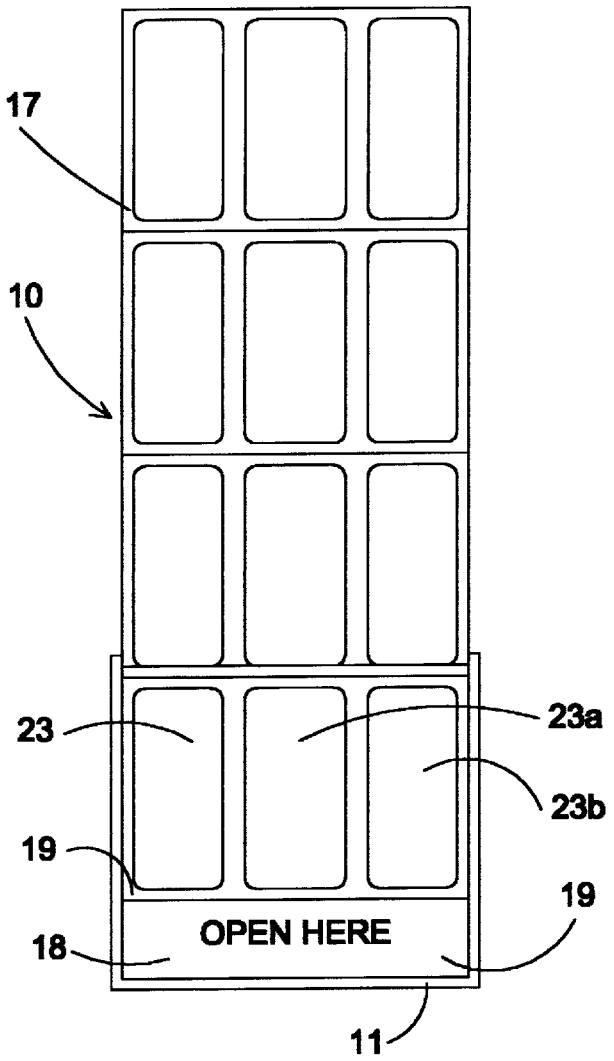
FIG. 4 is a perspective view of the novel finished page marker carrier assembly in the open position.
Figure 3:
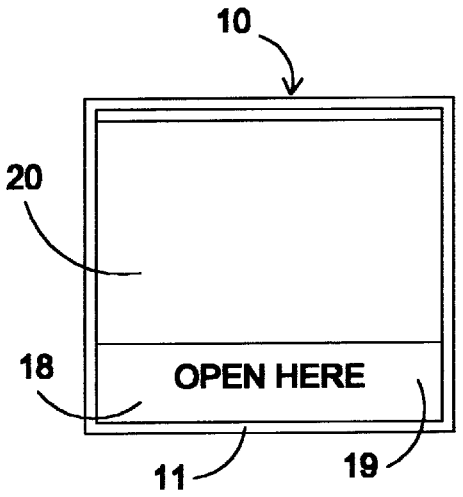
FIG. 3 is a perspective view of the novel finished page marker carrier assembly in the closed position.
Figure 5:
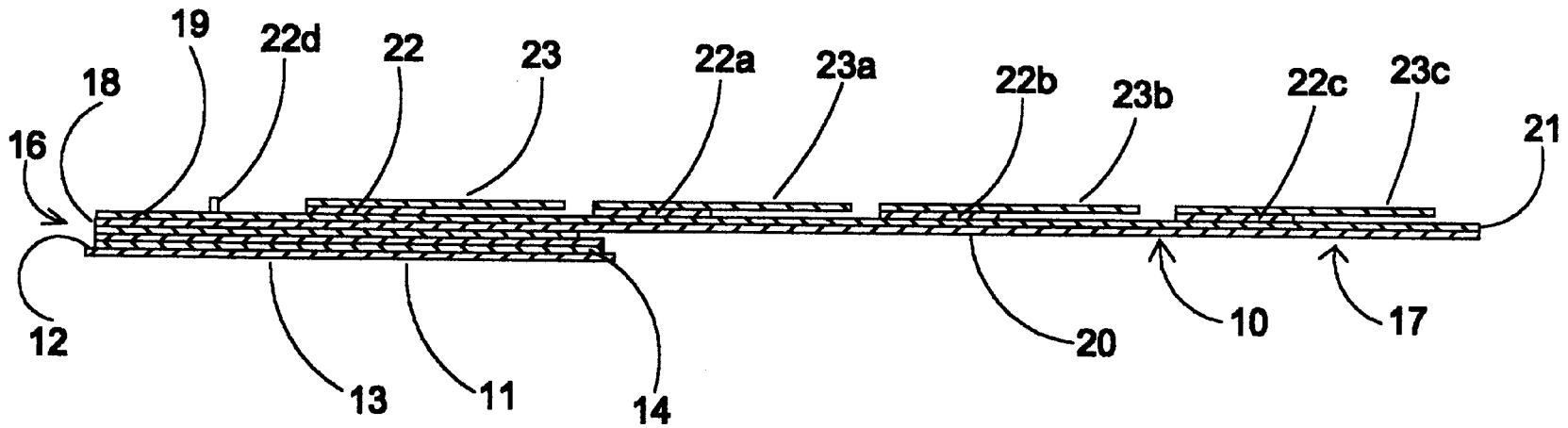
FIG. 5 is a side view of FIG. 4.

As shown in the figures, the novel page marker carrier assembly 10 comprises a primary unit comprising a liner 11 having a top or front side 12 and a rear or bottom side 13. The liner 11 has a layer of adhesive 14 on the top side 12 and a facestock 15 positioned on top of the adhesive 14. The combination of the liner 11, layer of adhesive 14 and the facestock 15 comprises the primary unit 16 of construction of the removable note product carrier assembly 10. The liner 11 comprises a carrier for the entire assembly 10 and is a pressure sensitive material, either cellulose, plastic or synthetic materials. The facestock 15 comprises a facestock of pressure sensitive material of cellulose plastic or synthetic material.

The secondary unit 17 of construction consists of a sheet of material 18 having a top or front side 19 and a rear or bottom side 20 that can be coated on one or both sides with a release coating. A layer of release coating 21 is positioned over the top side 19 of the sheet of material 18. Patterns of adhesive 22, 22*a*, 22*b* and 22*c* are positioned over the release coating in locations determined by the specific commercial design being prepared. The individual page marker tabs 23, 23*a*, 23*b*, 23*c* and 23*d* comprise the tertiary unit and they are comprised of a sheet of page marker tab material that is die cut into position over the adhesive patterns 22, 22*a*, 22*b* and 22*c*. The specific adhesive used can be removable, repositional or permanent depending upon the specific needs of the designed product.

The primary unit 16 and the secondary unit 17 are laminated together with the use of a permanent adhesive 24. The secondary unit 17 is then folded over at least twice to enclose the page marker tabs of the page marker carrier assembly. The entire secondary unit 17 is folded and die cut in order to allow the folded unit to be unfolded when desired to access the page marker tabs.

The novel method 30 of producing a page marker carrier assembly comprises the following steps: providing a plurality of sheets of material, each of said sheets having a front side and a rear side forming a plurality of units 31; printing the sheets of material 32; applying a coating of release agent in pre-determined areas of the carrier sheet of material 33; applying at least one adhesive layer as desired over said coating of release agent 34; providing said sheet of material comprising page marker tab material over the adhesive layer on said carrier sheet of material 35; die cutting the page marker tab material into page marker tabs 36; stripping away waste matrix material 37; folding said carrier sheet as necessary to form the carrier for said page markers 38; attaching said folded carrier sheet of material onto a pressure sensitive base 39; die cutting the combined unit as necessary 40; and stripping away the waste matrix material in order to provide a finished page marker carrier assembly 41.

The multiple layers of material is produced from two separate webs of material. The flexibility provided to the manufacturer afforded by this process allows an infinite number of items that can be produced and carried by the page marker carrier assembly and permits an ease of accessibility for the consumer. After the assembly is completed, it is fanfolded or rewound for shipping.

While I have described my invention in connection with specific embodiments thereof, it is clearly to be understood that this is done only by way of example and not as a limitation to the scope of my invention as set forth in the objects thereof and in the appended claims.

I claim:

1. A page marker carrier assembly, for use in providing page marker tabs which can be used by a consumer by opening the page marker carrier assembly, unfolding the page marker carrier sheet, and removing the page marker tabs from the assembly and positioning it on another location, said structure comprising:

a page marker carrier assembly comprising a plurality of units;

a primary unit comprising a pressure sensitive material, said material having a facestock ply, said facestock ply having a front side and a back side;

said primary unit further comprising a liner ply, said liner ply having a front side and a back side;

said back side of said facestock ply having a coating of pressure sensitive adhesive;

said front side of said liner ply having a layer of release coating thereon;

said primary unit having a coating of adhesive on said front side of said facestock ply for facilitating Lamination with the secondary unit;

said secondary unit comprising a sheet of material, said sheet of material having a front side and a back side, a portion of said back side of said sheet of material being laminated to said primary unit;

said sheet of material of said secondary unit comprising a folded unit;

said front side of said secondary unit having a layer of release coating positioned thereon;

selected areas of said layer of release coating on said front side of said secondary sheet having adhesive positioned thereon;

a tertiary unit comprising at least one page marker tab, said page marker tab having a front side and a back side;

said back side of said page marker tab having a layer of adhesive positioned thereon from said secondary unit during the lamination process; and said secondary and said tertiary unit comprising a folded unit such as to confine said page marker tabs to the interior of said folded unit.

2. A page marker carrier assembly, according to claim 1 wherein;

said facestock ply of said primary unit comprises a document of cellulose material.

3. A page marker carrier assembly, according to claim 1, wherein:

said facestock ply of said primary unit comprises a document of plastic material.

4. A page marker carrier assembly, according to claim 1, wherein:

said facestock ply of said primary unit comprises a document of synthetic material.

5. A page marker carrier assembly, according to claim 1, wherein:

said layer of adhesive on said front side of said facestock ply of said primary unit comprises the use of permanent adhesive.

6. A page marker carrier assembly, according to claim 1, wherein:

said layer of release coating comprises the use of silicone thereon.

7. A page marker carrier assembly, according to claim 1, wherein:

said layer of release coating comprises the use of a dry strippable release coating thereon.

8. A page marker carrier assembly, according to claim 1, wherein:

said secondary unit comprises a unit folded over itself to form a carrier unit.

9. A page marker carrier assembly, according to claim 1, wherein:

said tertiary unit forming said page marker tab comprises material cut into a plurality of page marker tabs.

10. A page marker carrier assembly, according to claim 1, wherein:

said tertiary unit forming said page marker tabs comprises a document of cellulose material.

11. A page marker carrier assembly, according to claim 1, wherein:

said tertiary unit forming said page marker tabs comprises a document of plastic material.

12. A page marker carrier assembly, according to claim 1, wherein:

said tertiary unit forming said page marker tabs comprises a document of synthetic material.

13. A page marker carrier assembly, according to claim 1, wherein:

said adhesive positioned over said areas of said layer of release agent on said secondary unit comprises the use of a permanent adhesive.

14. A page marker carrier assembly, according to claim 1, wherein:

said adhesive positioned over said areas of said layer of release agent on said secondary unit comprises the use of a repositional adhesive.

15. A page marker carrier assembly, according to claim 1, wherein:

said adhesive positioned over said areas of said layer of release agent on said secondary unit comprises the use of removable adhesive.

16. A page marker carrier assembly, for use in providing page marker tabs which can be used by a consumer by opening the page marker carrier assembly, unfolding the page marker carrier sheet, and removing the page marker tabs from the assembly and positioning it on another location, comprising in combination:

a page marker carrier assembly comprising a base unit and a carrier unit being adjacent to each other and a page marker tab unit, said base unit and said carrier unit having a front side and a rear side;

said base unit comprising in combination a sheet of material, said sheet of material having a layer of adhesive on said front side and a liner attached to said front side thereof, and said liner having a layer of adhesive positioned on the side away from said sheet of material;

said carrier unit comprising in combination a sheet of material, said sheet of material having a layer of release coating positioned on said front side thereon and a pattern of adhesive positioned over said release coating, and at least one page marker tab unit positioned on said adhesive over said release material; and said sheet of said carrier unit comprising a unit to be folded into position over said first unit and enclosing said page marker tab unit therein.

17. A method of producing a page marker carrier assembly, for use in providing page marker tabs which can be used by a consumer by opening the page marker carrier assembly, unfolding the page marker tabs from the assembly and positioning it on another location, said method comprising the steps of:

providing a plurality of sheets of material, each of said sheets having a front side and a rear side forming a plurality of units;

printing the sheets of material;

applying a coating of release agent in pre-determined areas of the secondary sheet of material;

applying at least one adhesive layer as desired over said coating of release agent;

providing a sheet of material comprising page marker tab material over said adhesive layer on said secondary sheet of material;

die cutting the page marker tab material into tabs;

stripping away waste matrix material;

folding said secondary sheet of material as necessary to form the carrier for said page markers tabs, and for positioning the folded carrier over one of the coated areas of adhesive for sealing the unit and for providing opening and closing of the folded carrier;

applying said folded carrier layer of material onto a pressure sensitive base;

die cutting the combined unit as necessary;

stripping away the waste matrix material in order to provide a finished page marker carrier assembly.

18. A method of producing a page marker carrier assembly, according to claim 17, wherein:

said providing a plurality of sheets of material step comprises a primary unit, a secondary unit attached to said primary unit and folded over said primary unit, and a tertiary unit comprising page marker tabs positioned within said folded secondary unit.

19. A method of producing a page marker carrier assembly, according to claim 17, wherein:

said applying a coating of release material comprises positioning a layer of silicone over said secondary unit.

20. A method of producing a page marker carrier assembly, according to claim 17, wherein:

said applying at least one adhesive layer step comprises using a permanent adhesive on said primary unit.

21. A method of producing a page marker carrier assembly, according to claim 17, wherein:

said folding said secondary unit step comprises folding the secondary unit over itself at least once to form the carrier unit for the page marker tabs.

* * * * *